United States Patent [19]

Takano et al.

[11] Patent Number: 4,665,847

[45] Date of Patent: May 19, 1987

[54] AUTOMATIC SEWING MACHINE

[75] Inventors: Kunio Takano, Tokyo; Masanori Nukushina, Kanagawa, both of Japan

[73] Assignee: Tokyo Juki Industrial Co., Ltd., Chofu, Japan

[21] Appl. No.: 675,255

[22] Filed: Nov. 27, 1984

[30] Foreign Application Priority Data

| | | | |
|---|---|---|---|
| Nov. 30, 1983 | [JP] | Japan | 58-227288 |
| Dec. 26, 1983 | [JP] | Japan | 58-246833 |
| Dec. 29, 1983 | [JP] | Japan | 58-251446 |

[51] Int. Cl.[4] ..... D05B 21/00

[52] U.S. Cl. ..... 112/121.12; 112/254; 112/314

[58] Field of Search ..... 112/121.12, 121.11, 112/102, 103, 254, 311, 314, 453, 456

[56] References Cited

U.S. PATENT DOCUMENTS

| | | | |
|---|---|---|---|
| 4,135,459 | 1/1979 | Manabe et al. | 112/121.12 |
| 4,221,176 | 9/1980 | Besore et al. | 112/121.12 |
| 4,385,570 | 5/1983 | Yanagi | 112/262.1 X |
| 4,413,574 | 11/1983 | Hirota et al. | 112/121.12 |
| 4,444,134 | 4/1984 | Maruyama et al. | 112/121.12 |

*Primary Examiner*—Peter Nerbun

*Attorney, Agent, or Firm*—Tarolli, Sundheim & Covell

[57] ABSTRACT

There is provided an automatic sewing machine which comprises, a main shaft, a bed, a needle bar having a needle secured to the lower end thereof, a thread straining control device, an operation device and an alarm device.

3 Claims, 12 Drawing Figures

AUTOMATIC SEWING MACHINE

BACKGROUND OF THE INVENTION

This invention relates to an automatic sewing machine in which a workpiece holder having a workpiece held thereon is moved horizontally relative to the sewing needle to form a seam on the workpiece and automatically ceases its operation at the completion of formation of the seam and which comprises a thread straining control device adapted to strain the upper and lower threads under control by moving the workpiece holder relative to the needle, an operation device adapted to position the needle drop point in a position not to interfere with the insertion and removal of the workpiece into and from the sewing zone on the sewing machine bed and a display device adapted to notify the completion of computation of holder movement amount data to the operator.

In the conventional automatic sewing machines of the type referred to above, as shown in FIG. 6 of the accompanying drawings, during the time period from the timing $t_0$ when the needle rises from a position below the throat plate towards a position above the throat plate to the timing $t_1$, when the needle descends from the rised position towards the position below the throat plate, the workpiece holder has moved by a predetermined amount. However, in order to strain the threads to a proper degree, it has been designed that the termination timing of the workpiece feed (movement of the workpiece holder) is brought close to the above-mentioned timing $t_1$. The reason is that when the needle 4 is high above the workpiece W at the completion of feed of the workpiece W as shown in FIG. 2, the length of the threads extending between the needle drop point for one stitch and the next needle drop point for the stitch immediately after the first-mentioned stitch is excessively increased. Thus, when the needle descends down to interconnect the threads and then the thread take-up lever rises, the rising movement of the lever does not sufficiently absorb slack in the upper thread and thus, the upper thread is not properly strained. Therefore, it has been proposed to coincide the timing of the workpiece feed with the timing of the termination of full descending movement of the needle 4 (feeding and straining).

In the above-mentioned prior art arrangement, assuming that the timing of workpiece feed completion is constant, when the workpiece has a relatively great thickness, the needle tends to contact the workpiece before the workpiece feed terminates resulting in the workpiece getting damaged. On the other hand, when the workpiece is relatively thin, the tension in the thread or threads is insufficient. Thus, it is necessary to adjust the timing of workpiece feed completion depending upon the thickness of a workpiece to be sewn. However, in the prior art arrangement, it requires a highly skilled hand for manipulating the internal mechanism of the sewing machine such as loosening the screws to allow the adjusting member to move by a predetermined amount for attaining the adjustment, the adjusting procedure becomes complicate and requires a prolonged time period.

As the automatic sewing machine referred to herein, various cycle sewing machines are known such as bartack, button hole darning, button fixing and embroidary sewing machines. Particularly, of late, electronic control sewing machines have been developed in which a pair of stepping motors are operatively conncted to a workpiece holder holding a workpiece thereon and the stepping motors are controlled based on informations stored in an information carrier such as a floppy disk whereby a seam of predetermined shape can be formed. In such a sewing machine, in the co-ordinates X, Y showing the position of a workpiece holder having the origin $O_1$ as shown in FIG. 9, when a pattern A - B - C - D is sewn from the needle drop point A for the first stitch, the needle moves from an optional point K through the origin $O_1$ to the needle drop point A for the first stitch and thus, the needle interferes with the insertion and removal of the workpiece into and from the sewing zone on the sewing machine.

In another prior art cycle sewing machine, a pair of stepping motors are operatively connected to a workpiece holder holding a workpiece thereon to drive the holder in X, Y directions, respectively, and movement data relating to movement of the holder are given by a floppy disk or the like to a memory. In such a sewing machine, a switch adapted to set numeral values is provided on the framework of the sewing machine so that the operator can optionally set data relating to selection of sewing patterns and magnification and reduction rates of the selected sewing patterns and movement amount of the workpiece holder for one stitch are computed based on data from the floppy disk.

In the prior art sewing machine described just above, the computation is performed during the time period from the timing at which the needle comes up out of the workpeice to the timing at which the needle pierces through the workpiece again for each stitch. However, such computation procedure requires a rather long time for each stitch and decreases the sewing operation speed.

In order to eliminate the drawbacks, it has been proposed that data relating to movement amount of seams of one cycle are previously computed by data from the floppy disk and values set by the switch prior to commencement of sewing, the computed result is stored in a memory means such as RAM or the like and after data for one cycle have been stored, sewing operation on the sewing machine is then commenced based on the data whereby sewing speed is increased because the time for computing movement amount data is not increased in the sewing time.

However, in the arrangement described just above, when sewing data to be computed are complication such as arcuates requiring a rather long time for computation, since the operator can not positively confirm when the computation terminated, the operator is at a loss as to when the operator actuates the sewing machine.

SUMMARY OF THE INVENTION

Therefore, the present invention is to eliminate the drawbacks inherent in the prior art sewing machines referred to hereinabove.

One object of the present invention is to provide a cycle sewing machine adapted to move a workpiece holder and the sewing needle relative to each other by electric drive means such as stepping motors in which a manual switch which can adjust the relative movement between the needle and holder and also timing of the relative movement is provided whereby the feed and straining of thread or threads can be readily performed.

Another object of the present invention is to provide such a cycle sewing machine with an operation device which comprises means for moving a workpiece holder to a variably settable second origin $O_2$ and means for storing movement amount of the holder to thereby confirm the relative movement from the second origin $O_2$ to the needle drop point A for a first stitch.

A further object of the present invention is to provide such a sewing machine with an arrangement in which after computation of the movement data relating to the workpiece holder, means for displaying the computation termination is actuated to accelerate confirmation of set values of sewing pattern and magnifying rate of the sewing pattern.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the scope of the same in any way.

DETAILED DESCRIPTION OF THE PREFERRED EMBODIMENT

Figure 1:
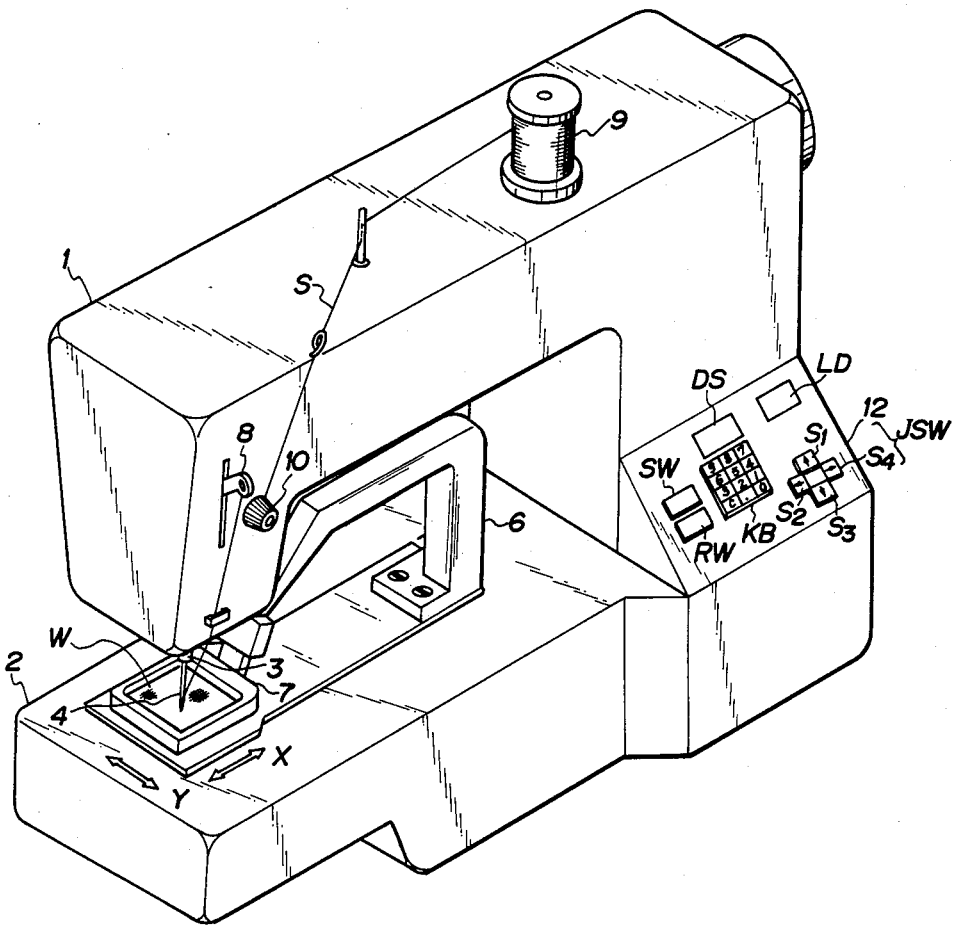
FIG. 1 is a perspective view of the cycle sewing machine embodying the principle of the present invention.

The present invention will be now described referring to the accompanying drawings which show one preferred embodiment of the invention and more particularly, to FIG. 1 thereof in which the outer appearance of the bar-tack sewing machine embodying the present invention is shown in a perspective view.

Figure 3:
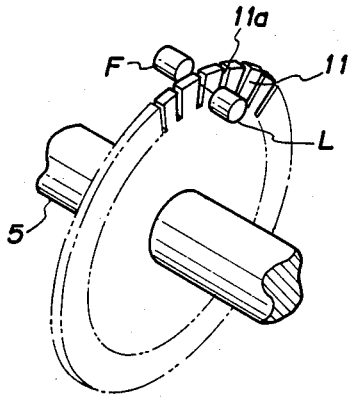
FIG. 3 is a perspective view of the pulse generation means associated with the main shaft.

The bar-tack sewing machine generally comprises a machine body 1, a bed 2, a needle bar 3 having a needle 4 secured to the lower end thereof and a main shaft 5 (FIG. 3). The needle bar 3 moves upwardly and downwardly as the main shaft 5 rotates. A movable member 6 is connected at the base end thereof to a pair of stepping motors XM and YM (FIG. 4) for movement in X - Y directions as shown in Japanese Laid-Open Patent Application No. 55177/1982, for example. The leading end of the movable member 6 has a workpiece holder 7 (workpiece holding-down member) secured thereto.

Figure 6:
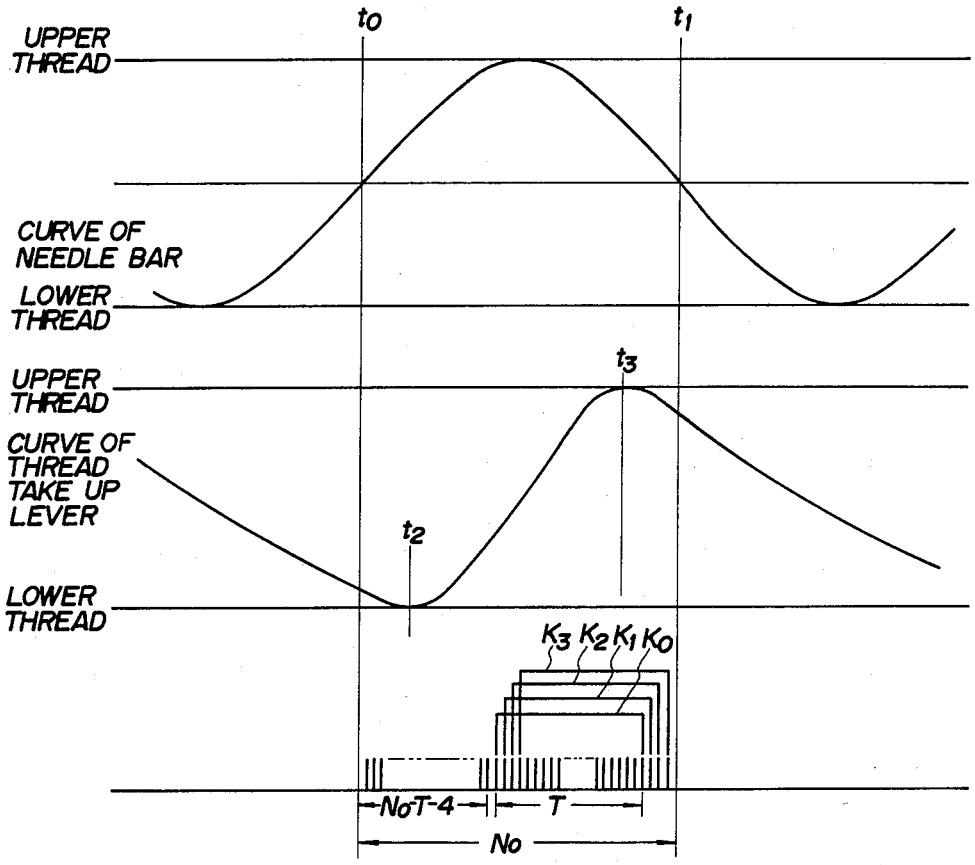
FIG. 6 is a time chart showing the phase relationship between upward and downward movement of the thread take-up lever and workpiece feed time period.

A thread take-up lever 8 is supported on the front of the body 1 for supporting thereon a thread section S which extends between the needle 4 and a thread supply source 9 and the lever moves upwardly and downwardly in the phase as shown in FIG. 6 as the main shaft 5 rotates.

A thread tension regulator 10 is supported on the front of the body 1 below the lever 8 in the upper thread path extending between the lever 8 and thread supply source 9 for imparting tension to the upper thread section S and the thread tension regulator is manually manipulated to adjust tension on the upper thread section S.

Figure 2:
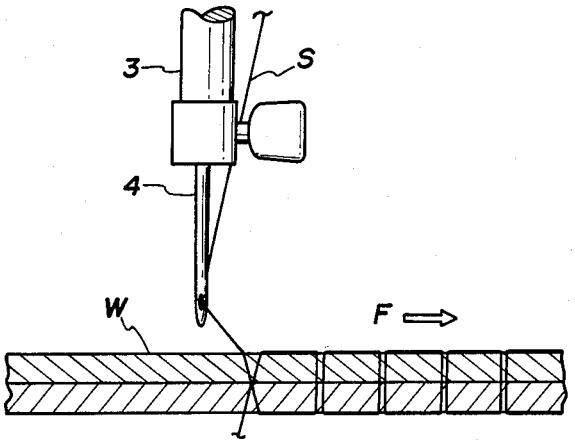
FIG. 2 is a view showing the operation of the thread feed and straining device.

Control Device (FIGS. 2 and 3)

The control device of the sewing machine according to the present invention comprises a discshaped rotary member 11 secured to the main shaft 5 inwardly of the framework of the sewing machine and having a plurality of equally spaced slits ll*a* in the periphery thereof, a light receiving element F secured to the sewing machine framework facing one side of the rotary member 11 and a light emitting element L secured to the machine framework facing the opposite side of the rotary member 11 in opposition to the light receiving element F. The rotary member 11, light receiving element F and light emitting element L constitute a pulse generator DT in which when the main shaft 5 rotates, the rotary member 11 rotates in synchronization with the rotation of the main shaft whereby the light emitting element L emits light which is received by the light receiving element F through the slits $\mathbf{11}_a$ in the rotary member 11 whereupon pulse signals are generated at a predetermined time interval. The number of the slits ll*a* is so selected that the number of pulse signals to be generated during the time period $t_0 - t_1$ will be No.

A control board 12 is detachably secured to the front of the sewing machine body 1 and provided on the control board of an actuation switch SW, a key board KB for setting or inputting sewing patterns to be selected, magnification and reduction rates of the selected sewing patterns and thread feed and straining amounts or numeral value data relating to numbers of stitches or the like as will be described hereinafter, a preparatory switch RW, a display DS for displaying the input to KB, a luminous display menas LD including the light receiving and emitting elements F and L and a jogging switch JSW including upper, right-hand, lower and left-hand switches $S_1$, $S_2$, $S_3$ and $S_4$. The control board 12 is electrically connected to the machine body 1 by means of an electrical cord (not shown).

Figure 4:
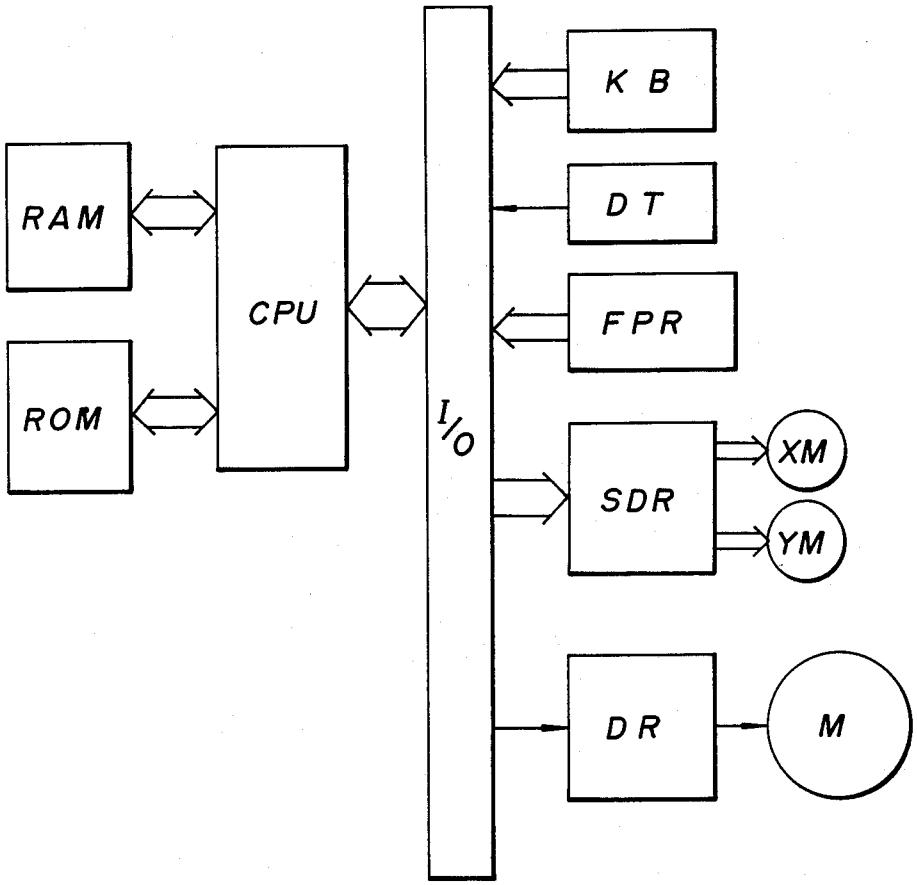
FIG. 4 is a block diagram of the control circuit for the thread feed and straining device.

Control Circuit (FIG. 4)

Figure 5:
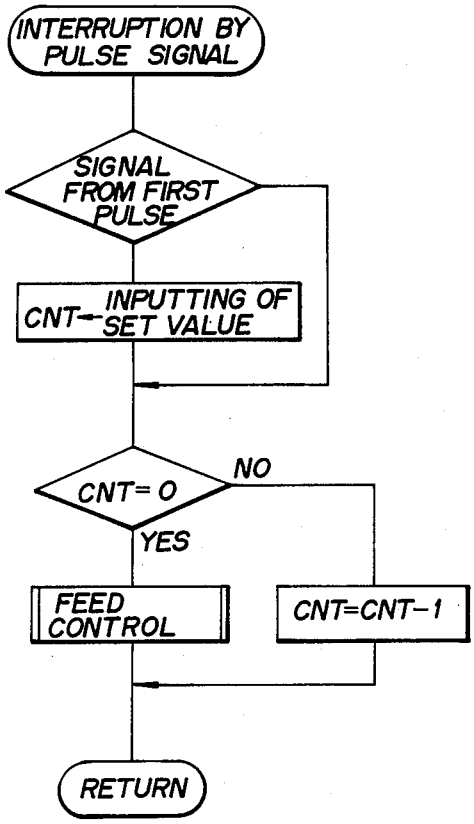
FIG. 5 is a flowchart of the sub-routine to be called by the interruption with a pulse signal.

The control circuit comprises as shown in FIG. 4 a random access memory RAM into and from which data are optionally written and read and which stores floppy disk data temporally, a read only memory ROM for storing the control program as shown in FIG. 5 or the like, a central processor CPU which has computing, inputting and outputting functions, a drive circuit SDR for generating step pulses to drive the stepping motors XM and YM and a drive circuit DR for driving a motor M connected to the main shaft 5.

The control circuit further includes the pulse generation means DT which comprises the rotary member 11, light emitting element L and light receiving element F (FIG. 3) as mentioned hereinabove, a read means FPR for reading a floppy disk (not shown) which stores workpiece feed amounts in X, Y directions for each stitch in a pattern sewing as data and an input and output circuit I/0 which functions as an interface for inputting and outputting signals among KB, DT, FPR, SDR and DR.

Now, the control operation of CPU will be described. It is assumed that $X_1$ and $Y_1$ represent movement amount data of the workpiece holder 7 in X and Y directions computed based on data stored in the floppy disk, respectively.

When the larger one of $X_1$ and $Y_1$ is assumed as T, the main program (not shown) of CPU performs such control operation that pulse signals ($N_0$ - T - 4) are counted from $t_0$ when the needle comes up out of the workpiece and thereafter, the sub-routine of FIG. 5 is interrupted each time one pulse signal is generated.

The flowchart sub-routine of FIG. 5 will be now described. When the main program is interrupted by a pulse signal, it is determined whether the pulse signal is the first pulse signal or not in the sub-routine, that is, the pulse signal is on the ($N_0$ - T - 3) order from the timing $t_0$ or not and if the pulse signal is the first pulse signal, a predetermined register CNT in the sub-routine stores values n (values from 1 to 3) for feed and straining. Thereafter, it is determined whether the value in CNT is "0" or not and if the value is "0", the stepping motor XM or YM or both the motors are driven by one step based on sewing pattern data. And if the value stored in CNT is not "0", the value in CNT is deducted therefrom by "1". After the process has completed, the control operation returns to the main program.

The purpose of interruption of the program of FIG. 5 after counting of pulse signals ($N_0$ - T - 4) from the timing $t_0$ is to make it possible to perform the so-called feed and straining by aligning the workpiece feed time period $K_0$–$K_3$ set corresponding to values "0" - "3" for feed and straining amounts, respectively, with the later part of the time period during which the needle is up out of the workpiece.

And the formula ($N_0$ - T - 4) is established for the reason why values set for feed and straining are four steps, that is, "0"–"3" and generally, when values for feed and straining are set as "0" - "m" and m +1 steps are settable, respectively, after ($N_0$- T - m - 1) pulse signals from the timing $t_0$ have been counted, the sub-routine of FIG. 5 is interrupted.

Operation

The upper thread S is payed out of the thread supply source 9 and guided over the thread tension regulator 10 and thread take-up lever 8 in succession to and passed through the needle 4, the workpiece W is secured to the workpiece holder 7, the power source to the sewing machine body 1 is closed and sewing pattern number and pattern magnifying rate are input to the control circuit by the keyboard KB whereupon the read means FPR reads sewing pattern data stored in the floppy disk which correspond to the sewing pattern input number. Workpiece feed amounts in X and Y directions for one stitch are counted from these read data and pattern magnifying rate and the count is stored in RAM.

After the count has been stored in RAM, the operator sets one of the values "0"–"3" by the keyboard in accordance with feed and straining amount to be set.

At this time, it is assumed that the workpiece W is relatively thin and the operator sets feed and straining amounts to "2".

Then, the actuation switch SW is pressed down whereupon the needle 4 pierces through the workpiece W and the sewing operation commences.

After the needle 4 has pierced through the workpiece W, the needle 4 comes up out of the workpiece at the timing $t_0$ (FIG. 6) whereupon CPU immediately begins to count pulse signals from the pulse generation means DT.

The thread take-up lever 8 rises at the timing $T_2$ to pull the upper thread S up whereby the lever begins to strain the thread.

At this time, assuming that workpiece feed amount data are $X_2$ and $Y_2$ in X and Y directions, respectively and $X_2 > Y_2$, then $T = X_2$ is set by the main program of CPU and when the count value of pulse signals in CPU exceeds ($N_0$ - T - 4), the sub-routine is interrupted each time one pulse signal is generated.

First, at the ($N_0$ - T - 4) +1 order pulse signal from $t_0$ ($t_5$ in FIG. 6) or the first pulse signal in the sub-routine of FIG. 5, a predetermined register CNT of CPU stores the value "2" set by the keyboard KB as the set feed and straining value. When the value of CNT becomes "2", the value of CNT is deducted by "1". Similarly, the value of CNT is further deducted by "1" to become "0" when the sub-routine is interrupted by the next pulse signal of $t_5$ the value of CNT becomes "0" when the sub-routine is interrupted by the pulse signal following the pulse signal $t_5$ and thus the stepping motors XM and YM are driven based on workpiece feed and straining amount data $X_2$ and $Y_2$ in X and Y directions, respectively and the workpiece holder 7 is moved thereby.

Thereafter, the value of CNT remains "0" because CNT is neither added thereto nor deducted therefrom any pulse signal by interruption of pulse signals and the motors continue to be driven.

Thus, in this case, since the workpiece feed time period is $K_2$, even after the thread take-up lever 8 has completed the thread strainer ($t_3$), the stepping motor XM continues to be driven to continue workpiece feed as shown in FIG. 6. Therefore, by the movement of the workpiece holder 7 in F direction after the timing $t_3$ as shown in FIG. 2, the workpiece feed completion timing is behind $t_3$ whereby the workpiece feed terminates after the needle 4 has fully descended and slack in the upper thread S extending from the needle 4 and connected to the workpiece W is taken up to thereby strain the thread.

And thereafter, when the needle 4 pierces through and then comes up out of the workpiece W again, CPU commences to count pulse signals in the same manner as described hereinabove and the workpiece feed time period $K_2$ is set in relation to the thread straining completion timing by the lever 8 based on workpiece feed amount data. That is, regardless of workpiece feed amount data, the movement amount (feed and straining amount) of the workpiece holder 7 after the thread straining completion timing by the lever 8 is set for each stitch.

Next, after the drive of the sewing machine has been ceased once, the workpiece W is replaced by a thicker workpiece and the feed and straining amount is set to "0" by the keyboard KB. Thereafter, when the sub-routine is interrupted at timing $t_5$ in FIG. 6 and then converted to the program as shown in FIG. 5, CNT stores "0" therein and the holder 7 then immediately starts to move at the timing $t_5$ because the value of CNT is "0". In this case, the workpiece feed time period is $K_0$. However, since $K_0$ is shifted ahead of $K_2$ (leftwards) for the thread straining completion timing $t_3$ by the thread take-up lever 8, the workpiece feed amount after the timing $t_3$ is smaller than that during the workpiece feed time period $K_2$ and thus, the height of the needle 4 at the workpiece feed completion timing is higher than that of the needle during the time period $K_2$, that is, the length of the thread extending between the needle 4 and workpiece W increases and the upper thread S having the increased length is positioned between adjacent needle drop points on the workpiece W. However, when the workpiece W is thick, even when the upper thread S is long, since slack in the thread is taken up by the workpiece W, a proper seam is formed on the workpiece.

From the foregoing description, it will be understood that in the workpiece feed time period $K_i$ ($0 \leqq i \leqq 3$), the smaller the value of i is, the more suitable the thread straining control device is for thick workpiece and on the contrary, the greater the value of i is, the more suitable the control device is for thin workpiece.

As mentioned hereinabove, according to the present invention, in a cycle or bar-tack sewing machine in which the needle and workpiece holder are moved relative to each other by electric drive means such as stepping motors, the relative movement between the needle adapted to feed and strain thread and the workpiece holder is adjustable by means of the manual switch and thus, by simple manipulation of the switch, the thread feed and straining can be adjusted depending upon workpiece thickness whereby a fine seam consisting of thread suitably strained can be formed without requiring any highly skilled hand.

Modified Embodiment

In the embodiment described hereinabove, although set feed and straining amount value is input to the control circuit by the keyboard, instead, a specific digital switch exclusively employed for the purpose can be provided. Alternatively, it is also contemplated that a potentiometer is disposed on the workpiece holder to generate voltage varying in response to rise of the holder, voltage generated by the potentiometer is converted by an A - D converter into a thread feed and straining amount value, the value is input to CPU whereby a suitable feed and straining amount of thread can be automatically set in accordance with workpiece thickness.

Furthermore, in the embodiment described hereinabove, although stepping motors XM and YM are employed as drive means for driving the workpiece holder 7, the present invention is not limited to the stepping motors as drive means and instead, servo-motors, linear stepping motors and linear servo-motors can be equally employed within the scope of the invention.

Figure 7:
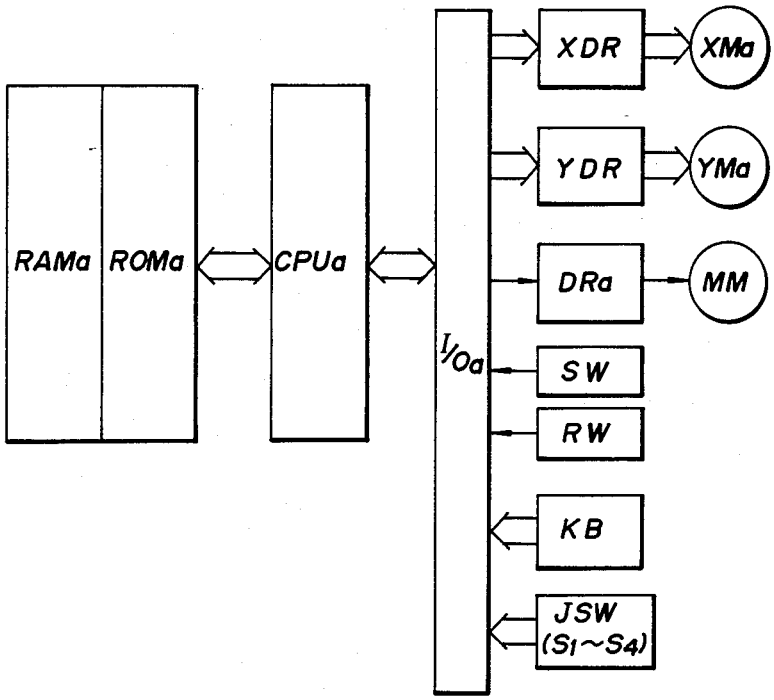
FIG. 7 is a block diagram of the control circuit for the sewing machine operation device.

Control Circuit of Operation Device (FIG. 7)

Figure 8:
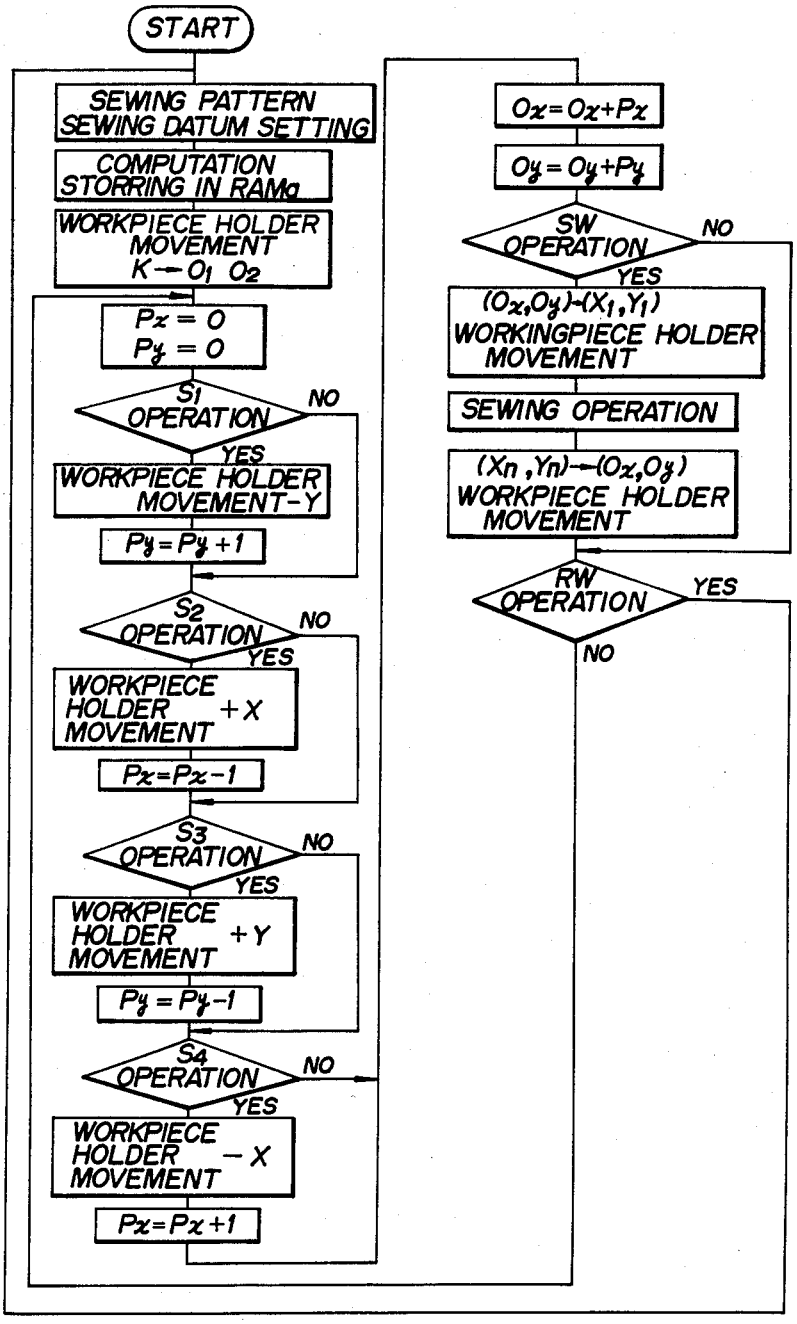
FIG. 8 is a flowchart of the control program for CPU.
Figure 9:
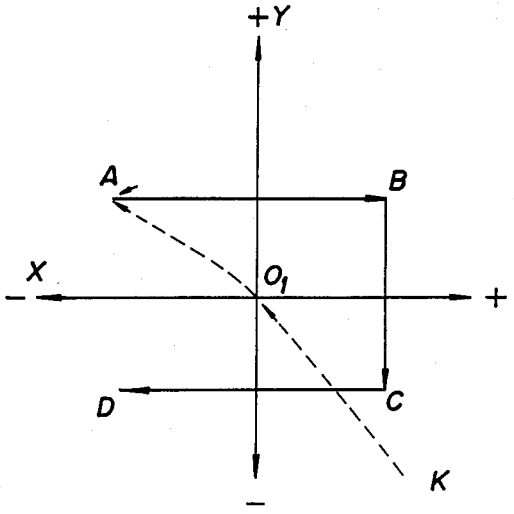
FIG. 9 is a view showing the relationship between a pattern and the second origin in a prior art bar-tack sewing machine.

Referring to FIG. 7 in which the control circuit of the operation device in the sewing machine according to the present invention is shown by a block diagram, the control circuit comprises a random access memory RAMa into and from which data are written and read and which stores floppy disk data temporally, a read only memory ROMa for storing the program as shown in FIG. 8 or the like and a central processor CPUa which has computing, inputting and outputting functions.

The operation device control circuit further includes drive circuits XDR and YDR for stepping motors XMa and YMa, respectively, a drive circuit DRa for a motor MM operatively connected to the main shaft and an interface circuit I/Oa for CPUa. I/Oa is designed to input and output command and signals among CPUa, XDR, YDR, DRa, SW, RW, KBa and JSW.

Although not shown, I/Oa has a read means for reading data from the floppy disk connected thereto.

Now, the program flowchart of the operation device control circuit will be described referring to FIG. 8. In order to start the sewing operation on the sewing machine, first of all, the keyboard KB selects a sewing pattern and sets magnification and reduction rates of the pattern, pattern data corresponding to the selected sewing pattern are read from the floppy disk, sewing data of each stitch are computed in CPUa using the magnification and reduction rates as parameters and the sewing data from CPUa are in succession written into RAMa.

Figure 10:
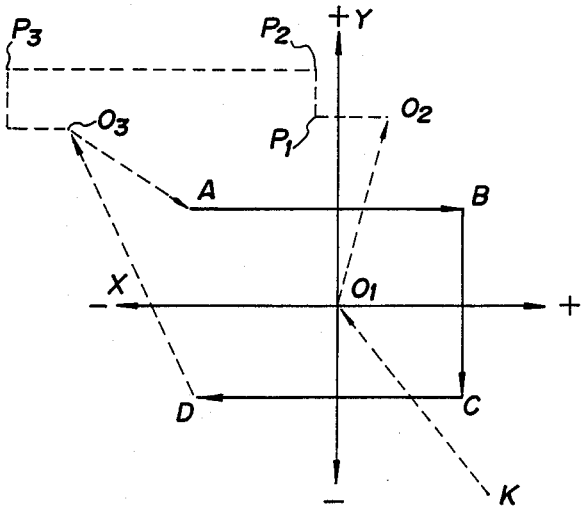
FIG. 10 is a view showing position adjustment of the second origin for a pattern in the instant bar-tack sewing machine.

The above-mentioned sewing data have a predetermined second origin $O_2$ as position data previously incorporated therein spaced from the sewing pattern A - B - C - D as shown in FIG. 10.

When data relating to one cycle sewing have been written into RAMa, the workpiece holder 6 moves the present needle position K (FIG. 10) to the predetermined second origin $O_2$ through the first origin $O_1$ The purpose for which the holder 6 passes through the first origin $O_1$ is to compensate for deviation which may occur in the stepping motors XMa and YMa.

After the completion of the operation described just above, both the values of movement parameters Px and Py of the workpiece holder 6 are reset to "0" whereupon the jogging switch JSW selects one of its switches for actuation when the upper switch $S_1$ is actuated, the holder 6 moves in $-Y$ direction by one pitch (the movement distance of the stepping motor XMa or YMa by a predetermined number of steps is referred to as "one pitch") and the value of $P_y$ is increased by "1" increment. And when the left-hand switch $S_2$ is actuated, the workpiece holder 6 moves in $+X$ direction by one pitch and the value of $P_y$ is increased by "1" increment, when the lower switch $S_3$ is actuated, the workpiece holder member 6 moves in $+Y$ direction and the value of $P_x$ is increased by "1" increment and when the right-hand switch $S_1$ is actuated, the workpiece holder 6 moves in $-X$ direction by one pitch and the value $P_y$ is increased by "1" increment.

When the actuation of the switches $S_1$–$S_4$ on the jogging switch JSW has been completed, the values of parameters $P_x$ and $P_y$ computed by the actuation of the switches $S_1$–$S_4$ are added to $O_x$ and $O_y$ which are the co-ordinates of x and y of the second origin $O_2$ whereby the co-ordinates of the second origin $O_2$ are displaced.

Next, the actuation switch SW is ready to be actuated and when the workpiece holder 6 moves from the displaced second origin co-ordinates ($O_x$ and $O_y$) to the first stitch needle drop points ($X_1$ and $Y_1$) of the selected sewing pattern and the stepping motors XM and YM move the workpiece holder 6 based on a plurality of sewing data ($X_1$ and $Y_1$) - ($X_n$ and $Y_n$) written in RAMa whereby the needle 4 pierces through and then comes up out of the workpiece so as to form a seam. When the formation of the seam has been completed to the last needle drop point ($X_n$, $Y_n$) in this way, the thread cutting device (not shown) provided on the underside of the sewing machine bed is actuated to cut the upper thread extending from the needle 4 and connected to the workpiece and the needle bar 3 is raised from the workpiece and maintained in the raised position and thereafter, the workpiece holder 6 is moved from ($X_n$, $Y_n$) to ($O_x$, $O_y$).

Next, the preparatory switch RW is ready to be actuated and when the switch RW is actuated, the keyboard KB again selects a sewing pattern and sets the magnification and reduction rates of the pattern, but when the preparatory switch is not actuated, $P_x$ and $P_y$ are made to "0" with the values of $O_x$ and $O_y$ maintained whereby the jogging switch JSW selects its switches.

Operation

After the sewing machine body 1 has been connected to the power source, the floppy disk (not shown) having various sewing pattern data stored therein is mounted on the sewing machine and the keyboard KB selects the sewing pattern as shown in FIG. 10 and sets the modification rate of the pattern. By this, sewing data are computed from the pattern data and magnifying rate set by the floppy disk and stored in succession in RAMa. At this time, the co-ordinates $O_x$, $O_y$ of the second origin $O_2$ are also computed. When all the sewing data for one cycle have been stored in RAMa, the stepping motors XMa, YMa are driven to move the workpiece holder 6 from the present needle drop position through the first origin $O_1$ to the second origin $O_2=(O_x, O_y)$.

Thus, when the workpiece is to be secured to the workpiece holder 6, the needle 4 which is now positioned at the second origin $O_2$ tends to touch the operator's finger or fingers to the degree that the needle impedes the securing of the workpiece to the holder. To avoid such impediment by the needle, the operator presses the left-hand switch $S_2$ of the jogging switch JSW several times to drive the stepping motor XMa to cause the motor to rotate by the steps corresponding to the pressing-down frequency to thereby move the workpiece holder 6 rightwards by the distance corresponding to the pressing-down frequency, that is, due to the relative relationship between the sewing pattern A - B - C - D and needle 4, the needle 4 moves leftwards relative to the sewing pattern A - B - C - D and the value $P_x$ representing the pressing-down frequency is increased in increment ($P_1$).

Next, when the upper switch $S_1$ is pressed down, the stepping motor YMa is driven to move the needle 4 upwardly, when the left-hand switch $S_2$ is pressed down, the needle 4 moves leftwards ($P_3$) and when the lower and right-hand switches $S_3$ and $S_4$ are in succession pressed down, the needle 4 moves in the sequence $P_3$-$P_4$-$P_3$.

By repeating the above-mentioned procedure, the position of the second origin $O_2=(O_x, O_y)$ varies, but each time one of the switches $S_1$–$S_4$ of the jogging switch JSW is pressed down, by the relationship $O_x=O_x+P_x$, $O_y=O_yP_y$, the value of ($O_x$, $O_y$) is renewed, that is, the co-ordinates ($O_x$, $O_y$) of the displaced second origin $O_2$ is always confirmed by CPU.

In this way, when the satisfactory second origin ($O_x$, $O_y$) is set as $O_3$ in FIG. 10, the co-ordinates ($O_x$, $O_y$) of $O_3$ and the way the movement (lost feed) amount of the holder from the first switch needle drop point ($X_1$, $Y_1$) of sewing data and direction of the movement are computed and the drive of the stepping motors XMa, YMa moves the workpiece holder 6 to ($X_1$, $Y_1$), whereby as the stepping motors XM, YM are driven based on the data of RAMa, the needle 4 pierces through and comes up out of the workpiece to thereby commence sewing from ($X_1$, $Y_1$).

The seam formation proceeds from ($X_1$, $Y_1$)=A to B - C - D=($X_n$, $Y_n$) to thereby complete one cycle of sewing whereupon the workpiece holder 6 is returned from ($X_n$, $Y_n$) to ($O_x$, $O_y$)=$O_3$.

Thereafter, when one of the switches $S_1$–$S_4$ of the jogging switch JSW is pressed down, the above-mentioned second origin ($O_x$, $O_y$) is displaceable.

And when the preparatory switch RW is pressed down, by manipulating the keyboard KB, new sewing pattern selection is made possible and pattern magnification and reduction rates can be set.

As mentioned hereinabove, according to the present invention, by the provision of the operation switch such as the jogging switch, the position of the second origin $O_2$ can be varied relative to the sewing pattern and thus, since the second origin $O_2$ can be moved depending upon the operator's right arm, the shape of the workpiece and the shape of the seam, the workpiece can be readily secured to and detached from the workpiece holder.

And in this case, by increasing and reducing predetermined parameters $P_x$, $P_y$ in response to the selective actuation of the jogging switch, even when the workpiece holder is moved to any position, the holder immediately moves to the needle drop point for the first stitch when the sewing operation starts and the seam pattern will not get out of shape because CPUa always grasps the position of the workpiece holder.

Modified Embodiment

In the embodiment described referring to FIGS. 7 to 10 inclusive, although the jogging switch is employed to move the second origin $O_2$, the present invention is, of course, not limited to the use of the jogging switch for the purpose and instead other switches such as lever and toggle switches may be also used within the scope of the invention. Alternatively, it will be easily occurred to those skilled in the art that the second origin may be moved by varying the program and arranging numerals on the keyboard KB in a particular pattern without the use of any jogging switch.

The present invention is also applicable to the sewing pattern in which the second origin $O_2$ is not spaced from the pattern, but the first stitch needle drop point and second origin $O_2$ coincide with each other. Furthermore, the movable member 5 may be driven by other motors such as a servo-motor or linear stepping motor.

Figure 11:
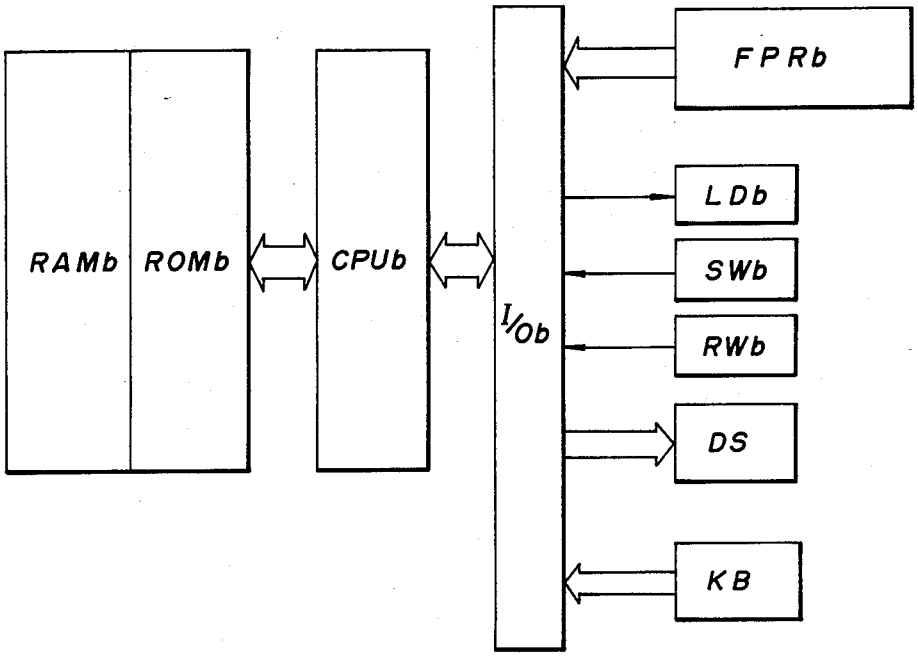
FIG. 11 is a block diagram of the control circuit for the display device.

Control Circuit of Alarm Device (FIG. 11)

Referring to FIG. 11 in which the control circuit of the alarm device of the invention is illustrated, the control circuit comprises a random access memory RAMb into and from which data are written and read and which stores data from a floppy disk (not shown) temporally, a read only memory ROMb storing the program of FIG. 3 therein, a central processor CPU having computing inputting and outputting functions, a read means FPRb for reading data from the floppy disk and I/Ob which interfaces data among the read device FPRb, light emitting member LD, actuation switch SW, preparatory switch RW, keyboard KB, display DS and CPUb. Although not shown, I/Ob has a stepping motor drive circuit connected thereto for driving the sewing machine main shaft drive motor and movable member 5.

Figure 12:
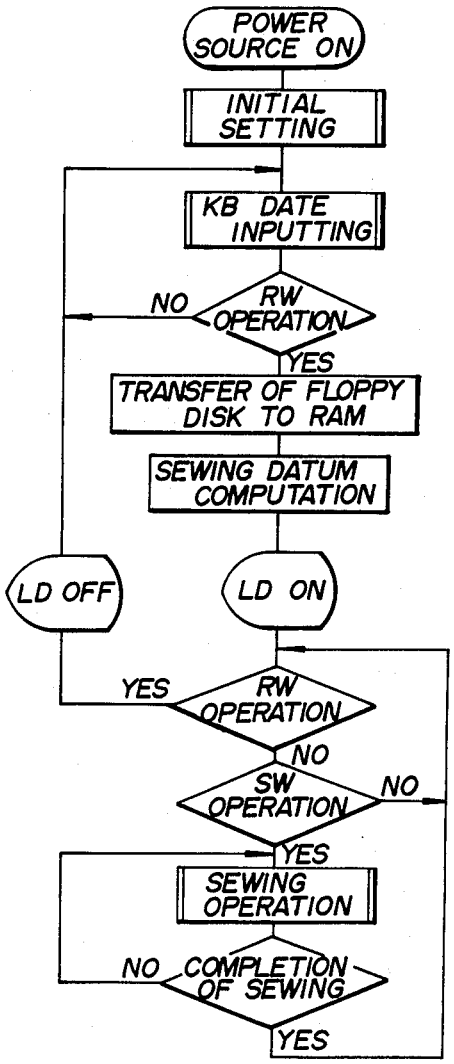
FIG. 12 is a flowchart of the control program for the display device.

Next, the flowchart of the program for the above-mentioned control circuit (FIG. 11) will be described referring to FIG. 12.

When the control circuit is connected to the power source (not shown), initial setting such as setting home position of the stepping motor so as to turn the light emitting member LDb off and drive the movable member. Next, when the keyboard KB sets numeral values (for example, type of pattern and magnifying rate of pattern), the sub-routine stores the numeral values in a predetermined register and the numeral values are displayed on the display DS. Thereafter, it is determined whether the preparatory switch RW is in its ON or OFF state and if the switch is in the OFF state, the keyboard KB is ready for actuation and if the switch RW is in the ON state, all data relating to one sewing pattern stored in the floppy disk are transferred to RAMb. The movement amount data of the workpiece holder 6 for each stitch are computed from the value set by the keyboard KB and the transferred data and the computed data are again stored in RAMb.

When the computation of sewing data for all the needle drop points for one cycle has been completed in this way, the light emitting member LD is turned off. Next, it is determined whether the preparatory switch RW is in its ON or OFF state and when it has been found that the switch RW is in the ON state, the light emitting member LD is turned off whereupon the keyboard KB again reads the value set by the keyboard KB. And when it has been found that the preparatory switch RW is in the OFF state, the actuation switch SW is turned on. When the preparatory RW is in the off state, the actuation switch SW is turned on. When the preparatory switch is in the OFF state, the keyboard KB is actuated, but when the actuation switch SW turns ON, the sewing operation commences. That is, the drive motor operatively connected to the main shaft is rotated and a seam is formed on the workpiece while moving the workpiece holder 6 in X and Y directions by the associated stepping motor based on sewing data stored in RAMb.

When the sewing operation on the workpiece in this way has been completed, the preparatory switch RW is again ready for actuation.

Operation

After the control circuit has been connected to the power source with the workpiece holder 6 having the workpiece secured thereto, first of all, the floppy disk having seam pattern data stored therein is mounted on the read memory FPRb and the keyboard KB inputs cycle seam datum number and magnifing rate from the floppy disk to the control circuit whereupon these numeral values are displaced on the display DS. Next, when the preparatory switch RW is pressed down, the seam data in the floppy disk corresponding to the pattern datum number and the value set by the keyboard KB are in succession written into RAMb. Thereafter, sewing data of the workpiece holder 6 for each stitch are computed from the pattern data and the value set by the keyboard KB written in RAMb as mentioned hereinabove.

Sewing data of the workpiece holder 6 for one cycle of sewing are counted in this way and the count is then stored in RAMb whereupon the light emitting member emits light whereby the operator notes that the storing of sewing data into RAMb has completed. At this time, even if the operator touches the keyboard KB by mischance, unless the preparatory switch RW is pressed down, there is no possibility that a new set value is displayed on the display DS. When it has been found that the pattern magnifying rate value set by the keyboard KB is wrong, the keyboard KB is operated again to correct the wrong set value whereby the light emitting member LD is deenergized and the new set value is stored in a predetermined register. Thereafter, when the preparatory switch RW is pressed down, the new set value and data of the floppy disk are in succession written into RAMb to compute the movement amount of the workpiece holder 6 and the computed data are also stored in RAMb. At the completion of storing of the data and set value, the light emitting member LD emits light again. Next, when it has been confirmed that the value set by the keyboard KB is correct, the actuation switch SW is pressed down whereby the drive motor operatively connected to the main shaft is driven and the stepping motors are driven based on data stored in RAMb to move the workpiece holder 6 in X or Y direction so as to form a predetermined seam on the workpiece.

At the completion of the formation of one cycle seam, the preparatory switch RW is ready for actuation. During the formation of one cycle seam, the light emitting member LD remains ON.

Thereafter, the sewn workpiece secured to the workpiece holder 6 is replaced by a new workpiece and when it has been confirmed that seam data are stored in RAMb by the ON condition of the light emitting member LD, the preparatory SW is pressed down and a seam similar to the seam previously formed on the previous workpiece is formed on the new workpiece.

As mentioned hereinabove, according to the present invention, by the provision of means (light emitting member LD) for displaying that the movement amount data of the workpiece holder 6 has been stored in RAMb and the arrangement by which the sewing machine is not actuated unless the actuation switch is actuated, the following effects can be obtained:

When data input to the control circuit by the keyboard KB are transferred to RAMb and seam data are computed, even if the pattern to be computed is complicate and requires substantial time for the computing, since the operator notes that sewing data are being computed by the OFF condition of the light emitting member LD and the operator also notes that the computation of seam data has been completed by the ON condition of the light emitting member LD, the operator can commence sewing operation on the sewing machine without being perplexed, while he is waiting for the completion of computation of sewing data.

And the energization of the light emitting member LD also serves to let the operator know that the value set by the keyboard KB can be varied or not.

In the embodiment described just above, although the light emitting member is employed as the displaying means, a non-light emitting member such as LCD can be employed. Alternatively, sound producing means such as a buzzer or speech synthesis LSI can be also employed.

As clear from the foregoing descriptions on the embodiments of the present invention, according to the present invention, in a cycle sewing machine in which the sewing needle and workpiece holder are moved relative to each other by electric drive means such as stepping motors, the relative movement timing of the needle and holder is adjustable by a manual switch whereby the feed and straining amount of the thread or threads can be easily adjusted depending upon workpiece thickness so as to enable to form fine seams with suitably strained threads without requiring a highly skilled hand.

The application of the present invention is not limited to the bar-tack sewing machine, but also applicable to other cycles sewing machines such as button fixing, but on hole darning and embroidery sewing machines.

While only one embodiment of the invention has been shown and described in detail, it will be understood that the same is for illustration purpose only and not to be taken as a definition of the invention, reference being had for this purpose to the appended claims.

What is claimed is:

1. A thread strain control device for an automatic sewing machine comprising:

a needle bar having a needle secured to the lower end and movable in response to the rotation of the main shaft of said sewing machine to sew a seam in a workpiece;

a workpiece holder for holding the workpiece and movable relative to said needle bar;

drive means connected to said workpiece holder and operable by electrical drive pulses to move the holder with respect to said needle bar;

memory means for storing feed data relating to the amount of movement of said holder during the sewing of a seam;

pulse generation means for generating pulse signals at a rate which is a function of the rotative speed of said main shaft in synchronization with the rotation of the shaft;

operation means for providing drive pulses to said drive means in synchronization with said pulse signals based on feed data from said memory means;

setting means for producing a plurality of setting signals varying depending upon the timing at which said drive pulses are provided to said drive means;

selection means for selecting one of said setting signals produced by said setting means;

shift means for varying the time period of said drive pulses provided by said operation means ahead of or behind a predetermined rotative angle of said main shaft in relation to said selected setting signals.

2. An alarm device for an automatic sewing machine, comprising:

a movable member;

a workpiece holder for holding a workpiece thereon secured to said movable member and movable relative to a needle bar;

drive means connected to said movable member for moving said holder in an X direction and a Y direction intersecting said X direction at right angles;

an information carrier for storing pattern data of said holder in said X and Y directions corresponding to a needle drop point of each of unitary patterns;

manual setting means for setting data to be added to said pattern data;

display means for displaying values set by said setting means;

computing means for computing sewing data representing the movement amount of said movable member for one stitch from said set values and pattern data;

memory means for storing computed data in succession;

control means normally inoperative and upon actuation for operating said drive means based on sewing data stored in said memory means;

manipulating means for manually operating said control means;

alarm means for giving notice to the operator upon actuation of said alarm means; and operation means for operating said alarm means in response to the termination of transfer of data for a pattern from said information carrier to said memory means.

3. An automatic sewing machine having a needle bar having a needle secured thereto and movable upwardly and downwardly in response to the rotation of a main shaft of said sewing machine, a movable member, a workpiece holder for holding a workpiece thereon, the workpiece holder being secured to the movable member and movable relative to the needle bar, drive means connected to the movable member for moving the movable member in an X direction and a Y direction perpendicular to the X direction from a first origin, memory means for storing needle position data of each sewing pattern in succession as movement data in the X and Y directions from a sewing start position to a sewing termination position, read means for reading movement data from the memory means, and first control means for driving the drive means based on the read movement data, characterized by a device comprising:

manual actuation means for generating actuation signals to actuate the drive source of said sewing machine;

manual operation means for generating position signals corresponding to the position in the X and Y directions before generation of said actuation signals;

second control means for controlling the drive means to move the movable member in response to said position signals;

second memory means for storing the position in the X and Y directions as a second origin in response to said actuation signals; and third control means for controlling the drive means to move said movable member from said second origin in response to said actuation signals to a sewing pattern sewing start position to start sewing the pattern.

* * * * *